US010906088B2

(12) United States Patent
Lafay et al.

(10) Patent No.: US 10,906,088 B2
(45) Date of Patent: Feb. 2, 2021

(54) COMPOSITIONS AND METHODS FOR IMPROVING CASTING QUALITY AND MOLD SAND ADDITIVES

(71) Applicant: Imerys Minerals USA, Inc., Roswell, GA (US)

(72) Inventors: Victor Lafay, Cincinnati, OH (US); Jeremy Tibbs, Morrow, OH (US); Felicia Daniels, Loveland, OH (US); Brian Burns, Lebanon, OH (US)

(73) Assignee: IMERYS USA, INC., Roswell, GA (US)

( * ) Notice: Subject to any disclaimer, the term of this patent is extended or adjusted under 35 U.S.C. 154(b) by 236 days.

(21) Appl. No.: 15/752,411

(22) PCT Filed: Aug. 11, 2016

(86) PCT No.: PCT/US2016/046562
§ 371 (c)(1),
(2) Date: Feb. 13, 2018

(87) PCT Pub. No.: WO2017/030899
PCT Pub. Date: Feb. 23, 2017

(65) Prior Publication Data

US 2019/0001399 A1 Jan. 3, 2019

Related U.S. Application Data

(60) Provisional application No. 62/205,253, filed on Aug. 14, 2015.

(51) Int. Cl.

| | |
|---|---|
| ***B22C 1/18*** | (2006.01) |
| ***B22C 1/02*** | (2006.01) |
| ***B22C 1/16*** | (2006.01) |
| ***B22C 3/00*** | (2006.01) |
| ***B22C 9/02*** | (2006.01) |

(52) U.S. Cl.
CPC ..... *B22C 1/181* (2013.01); *B22C 1/02* (2013.01); *B22C 1/16* (2013.01); *B22C 1/18* (2013.01); *B22C 3/00* (2013.01); *B22C 9/02* (2013.01)

(58) Field of Classification Search
CPC .... B22C 1/02; B22C 1/16; B22C 1/18; B22C 1/181; B22C 3/00; B22C 9/02
USPC ..... 164/5; 106/38.22, 38.27, 38.28, 38.9
See application file for complete search history.

(56) References Cited

U.S. PATENT DOCUMENTS

| | | | |
|---|---|---|---|
| 4,685,973 | A | 8/1987 | Ashton |
| 5,163,562 | A | 11/1992 | Wilhelm et al. |
| 5,992,499 | A | 11/1999 | Tordoff et al. |
| 6,834,706 | B2 | 12/2004 | Steele et al. |
| 9,138,803 | B2 | 9/2015 | LaFay et al. |
| 2012/0325113 | A1 | 12/2012 | LaFay et al. |

FOREIGN PATENT DOCUMENTS

| | | | |
|---|---|---|---|
| EP | 2191090 | A1 | 6/2010 |
| WO | WO 2011/082464 | A1 | 7/2011 |

OTHER PUBLICATIONS

Extended European Search Report dated Apr. 12, 2019, in corresponding European Application No. 16837546.7 (13 pages).
International Search Report and Written Opinion dated Oct. 26, 2016, in International Application No. PCT/US2016/046562 (9 pgs.).

*Primary Examiner* — Kevin P Kerns
(74) *Attorney, Agent, or Firm* — Finnegan, Henderson Farabow, Garrett & Dunner

(57) ABSTRACT

A method of forming a dry molding sand additive may include recovering a non-sand fraction from a foundry waste material and adding the non-sand fraction to a dry molding sand additive formulation to form a dry molding sand additive. Adding the non-sand fraction to the dry molding sand additive formulation may reduce the amount of fresh clay and carbon to produce the dry molding sand additive. A method of forming a molding sand additive may include recovering a waste molding sand additive composition having a clay or carbon content differing from a desired clay and carbon content, recycling the waste molding sand additive as a raw material in production of a fresh molding sand additive, and adjusting the amount of fresh clay or carbon added during production of the fresh molding sand additive to achieve the desired clay and carbon content.

17 Claims, 2 Drawing Sheets

COMPOSITIONS AND METHODS FOR IMPROVING CASTING QUALITY AND MOLD SAND ADDITIVES

CLAIM OF PRIORITY

This application a U.S. national phase entry under 35 U.S.C. § 371 from PCT International Application No. PCT/US2016/046562, filed Aug. 11, 2016, which claims the benefit of priority of U.S. Provisional Patent Application No. 62/205,253, filed Aug. 14, 2015, to both of which this application claims the benefit of priority, and the entirety of the subject matter of both of which is incorporated herein by reference.

FIELD OF THE DESCRIPTION

This disclosure relates generally to the field of sand cast molding and to improvements in the founding of metals. This disclosure also relates to improvements in sand molding media employed in forming molds into which molten metal is poured in the production of castings through recovering the molding waste for recycling into sand molding additives and molding compositions.

BACKGROUND

Green sand casting is a well-known process for forming cast metal articles. In this process, a casting mold for making castings is formed from molding media that is primarily sand and bentonite clay for the production of one or multiple castings. Once the casting solidifies in the mold, the mold is broken down, and the casting cycle is complete. A portion of the molding media can be recycled for another casting process; however, a substantial portion of the molding media exits the foundry as foundry waste. In the U.S. alone, foundry waste accumulates at a rate of approximately 6 to 10 million cubic yards per year. The large volume of foundry waste coupled with the increasing cost of landfill acreage and transportation is problematic.

Founding is an ancient art in which a cavity is defined in a sand mold and then molten metal poured therein. After the metal cools, the cast article is removed, with the sand mold usually being broken up in the removal process. The usual and basic procedure for forming such sand molds is to compact a sand molding medium around a pattern and then to remove the pattern, leaving a cavity having the configuration of the pattern.

In order for the sand to maintain its molded, cavity-defining configuration, a binding agent that causes the sand particles to cohere is included in the mixture. Clay has long been an accepted and suitable binding agent. Clay is a generic term and encompasses a large group of hydrous alumino-silicate minerals. Individual mineral grains vary in size down to microscopic dimensions. When dampened, clay is tenacious and plastic. When dampened and then dried clay becomes hard, particularly when dried at elevated temperatures. Wet bentonite product performs better under casting conditions.

The processes disclosed herein may be particularly useful in founding where so-called green sand casting is a standard practice. Green sand casting encompasses a process wherein molten metal is poured into a sand mold while it still retains the moisture that has been added to actuate the cohesive properties of the clay. Sand molding media for iron founding comprise three basic components, namely sand, clay, and finely ground bituminous coal, commonly known in the trade as "sea coal." In use, a sand molding medium is moistened with water to provide a medium that is capable of being compacted around a pattern to form a mold cavity. The green sand molds typically comprise by weight, from about 86% to 90% sand and multiple non-sand components, including 8% to 10% bentonite clay, 2% to 4% organic additives, and 2% to 4% moisture. After removal of the pattern, molten iron is poured into the mold cavity while the sand molding medium is still in its dampened or "green" condition. The sea coal on and immediately adjacent the mold cavity surface decomposes under the heat of the molten iron as it is poured into the mold. A product of this decomposition is elemental carbon, in the form of graphite, at the interface between the mold cavity and the poured iron. This elemental graphite serves the primary function of enabling the solidified casting to be released from the mold, free of sand particles. A secondary benefit of the elemental graphite is that it tends to level the surface of the mold cavity, thereby producing a smoother surface on the cast article.

A foundry may purchase a "pre-mix," which includes a clay component and carbon component. The foundry then mixes the pre-mix with sand from a local source to provide the sand molding media used in operations.

Sufficient cohesive strength of the sand molding medium is most critical in its "green" condition, that is, when it is moistened. After being compacted to define a cavity, the green molding medium preferably has sufficient strength to withstand any forces incident to removal of a pattern, so that the cavity configuration is maintained intact. Next, sand molding media, when in a green stage, preferably has sufficient strength to withstand the forces incident to the mold being moved and repositioned in various fashions in the process of preparing it for the pouring of metal into the cavity. Further, the sand molding media preferably has sufficient cohesive strength to withstand the hydraulic forces incident to pouring molten iron into the cavity.

Drying of a green mold occurs extremely rapidly and can occur while the metal is still molten and continues to exert hydraulic forces on the mold structure. The dry strength of the molding medium is therefore critical in assuring that the integrity of the mold will be maintained to the end of obtaining cast articles of the proper configuration.

Another significant, objective characteristic of sand molding media is permeability. A relatively high permeability is preferred in order to prevent damage to the mold when molten iron is poured into the mold cavity. This is to point out that when molten metal is poured into the mold cavity, air is displaced through the molding medium. More importantly, because the sand molding medium is damp, steam can be generated in a rather violent, or explosive, fashion. Such steam is preferably vented through the molding medium with a minimum of gas flow resistance. As such, porous mold structures preferably have a relatively high gas permeability. Strength characteristics and permeabilities are capable of objective determination, and acceptable green and dry strengths for sand molding media, as well as permeabilities, are now established.

After an item has been cast, the sand mold is broken up and then accumulated for reuse. The excess molding media, that is, foundry waste which cannot be reused for subsequent casting cycles, is generated at several locations within the foundry. The composition and particle size distribution of foundry waste can vary depending upon the areas of the foundry in which it is collected, but foundry waste can be generally classified in two broad categories, namely, "molding waste" and "bag house dust/dust from mechanical reclamation." The phrase "molding waste" refers to the excess molding media from broken-down green sand molds and cores, which can be output as a stream produced during shakeout. In many green sand foundries, the molding waste typically contains by weight from about 80% to about 90% sand, from about 6% to about 10% bentonite clay, and from about 1% to about 4% organic additives. Molding waste includes sand that is coated with bond as well as individual particles of sand, bentonite, and organic additives.

Attempts have been made to reduce the accumulation of molding waste by mechanical reclamation removing the bond from the sand so that the sand is sufficiently clean to be reused in the production of cores. In such processes the sand is recovered, but the bentonite clay, which costs several times more than sand on a weight basis, and the organic additives can be recovered. A disadvantage of mechanical reclamation is that the cost of prime sand is sufficiently low in many geographic areas that the capital investment for sand recovery is economically unfeasible.

In addition to molding waste, excess foundry green molding sand (wet) that is generated in the metal casting process can be disposed of as another waste stream. This so called "overflow green sand" waste stream generally comprises excess green sand including both the silica molding sand and associated molding sand additives in the relative proportions used in the foundry.

Another source of foundry waste includes fine particles of sand, bentonite clay, organic additives, and debris collected in the foundry's air evacuation system. This foundry waste is commonly known in foundries as "bag house dust." Bag house dust contains substantially more bentonite clay than does molding waste since the bentonite clay is finer than the sand used in the casting process and thus more easily transported in the air. Bag house dust typically comprises from about 40% to about 70% sand, from about 20% to about 50% bentonite clay, and from about 10% to about 30% organic additives.

The materials from the sand mold material are generally discarded after use because each casting may have different customer requirements for the molding material. The sand mold material is also unacceptable for further use due to contamination from the previous batch that does not meet a subsequent customer's requirements. Furthermore, as the sand mold material is transitioned from one customer's requirements to another, the intermediary compositions are suitable for neither application and are discarded. As a result, as much as 2000 pounds or more of sand mold material may be discarded by a single foundry per day. This discarded material results in significant waste and increased cost to the foundries due to disposal and landfill expenses.

The pre-mix discussed above, which includes a clay component and carbon component, has found acceptance in the art because of several advantages. Primarily these advantages are found in the ability to minimize costs by the use of less pre-mix and/or by reducing the total amount of carbonaceous material in the pre-mix. Further, it was demonstrated that the amount of additional, "make-up" pre-mix used in recycling a sand molding medium was reduced.

Another factor to note is that as green sand molding medium is compacted around a pattern (in the normal case) to form a mold cavity, the characteristics of the sand molding medium can have a great impact on the "workability" of the medium and the ability to compact (i.e., densify) the medium and also the ease with which densification can be attained, which is understood as flowability. This factor is relevant to the fact that both the green strength and dry strength of a sand molding medium are directly proportionate to the density of the sand molding medium after it has been compacted to define a mold cavity. There is thus a preference within the art for sand molding media that have a workability characteristic which facilitates obtaining a desired, relatively high, and consistent density of the compacted molding medium. While the workability characteristic is subjective, it is, nonetheless, a recognized standard for sand molding media.

Accordingly, it may be desirable to reduce the amount of foundry waste exiting a green sand foundry. It may be desirable to provide a process to recover sand that has a sufficient quality to be used in the foundry to make cores and green sand molds that can be used in subsequent casting processes. It may also be desirable to provide a process to recover non-sand components of the green sand molds to decrease the amount of new prime materials (pre-mix) that enter the foundry as raw material. It may further be desirable to provide a green sand mold composition with improved processing properties.

SUMMARY

According to one aspect of this disclosure, a method of forming a dry molding sand additive may include recovering a non-sand fraction from a foundry waste material and adding the non-sand fraction to a dry molding sand additive formulation to form a dry molding sand additive. Adding the non-sand fraction to the dry molding sand additive formulation may reduce the amount of fresh clay and carbon needed to produce the dry molding sand additive. According to some aspects, the non-sand fraction may include a recovered clay component and a recovered carbon component.

According to another aspect, the foundry waste material may include bag house dust. According to a further aspect, the foundry waste material may include overflow green sand. According to still another aspect, the foundry waste material may include a mixture of bag house dust and overflow green sand. According to yet another aspect, the foundry waste material may include molding waste.

According to another aspect, the moisture content of the dry molding sand additive may be in a range from about 0% to about 30% by weight. For example, the moisture content may be in a range from about 0% to about 20% by weight, from about 0% to about 15%, from about 0% to about 10%, from about 8% to about 15%, from about 5% to about 15%, from about 10% to about 25%, from about 0% to about 5%, from about 5% to about 10%, from about 10% to about 15%, or from about 15% to about 20% by weight.

According to another aspect, the method may include adjusting the composition of the dry molding sand additive such that the methylene blue adsorption value of the dry molding sand additive is in a range from about 70% to about 95%. For example, the composition of the dry molding sand additive may be adjusted such that the methylene blue adsorption value of the dry molding sand additive is in a range from about 70% to about 80%, from about 75% to about 85%, from about 80% to about 90%, or from about 85% to about 95%.

Methylene blue adsorption may be measured by weighing 5 grams of sand into a beaker and adding 50 ml of 3% tetrasodium pyrophosphate solution to the beaker. The beaker is then mixed for 5 minutes. The beaker is then removed and placed under a burette for methylene blue titration. 1 ml of methylene blue is then added to the beaker and the solution is stirred for 2 minutes using an agitator. Using a glass rod, a single drop of solution is removed and placed on a filter paper. The filter paper drop is observed to identify a light blue halo indicating excess methylene around the outside of the central spot. If a halo does not appear, additional methylene blue is added to the beaker, the stirring step is repeated, and another drop is added to the filter paper until a halo is observed. The addition of methylene blue is stopped when the halo is observed on the filter paper. The final volume of methylene blue added to the beaker is divided by a calibration factor to determine the methylene blue adsorption value. The calibration factor is based upon a historical bentonite sample from colony Wyoming and corrected for the variation in the methylene blue dye crystals.

According to still another aspect, a clay content of the dry molding sand additive is in a range of from about 60 wt % to about 90 wt %, such as, for example, in a range from about 60 wt % to about 80 wt %, from about 70 wt % to about 90 wt %, from about 60 wt % to about 70 wt %, from about 70 wt % to about 80 wt %, or from about 80 wt % to about 90 wt %.

According to still another aspect, a carbon content of the dry molding sand additive is in a range of from about 10 wt % to about 25 wt %, such as, for example, in a range from about 10 wt % to about 20 wt %, from about 15 wt % to about 25 wt %, from about 10 wt % to about 15 wt %, from about 15 wt % to about 20 wt %, or from about 20 wt % to about 25 wt %.

According to still another aspect, the dry molding sand additive formulation may include non-recovered material. According to yet another aspect, the dry molding sand additive may include greater than or equal to greater than or equal to about 25 wt % of non-recovered material. For example, the dry molding sand additive may comprise greater than or equal to about 30 wt %, greater than or equal to about 40 wt %, greater than or equal to about 50 wt %, greater than or equal to about 55 wt %, greater than or equal to about 60 wt %, greater than or equal to about 65 wt %, greater than or equal to about 70 wt %, or greater than or equal to about 75 wt % of non-recovered material.

According to a further aspect, the dry molding sand additive may include from about 1 wt % to about 75 wt % of the recovered non-sand fraction, such as, for example, from about 1 wt % to about 10 wt %, from about 10 wt % to about 20 wt %, from about 20 wt % to about 30 wt %, from about 30 wt % to about 40 wt %, from about 40 wt % to about 50 wt %, from about 50 wt % to about 60 wt %, from about 60 wt % to about 70 wt %, from about 1 wt % to about 25 wt %, from about 25 wt % to about 50 wt %, or from about 50 wt % to about 70 wt % of the recovered non-sand fraction.

According to still another aspect, the non-sand fraction may be added to the dry molding sand additive formulation as a slurry. According to some embodiments, the slurry may have a solids content of up to about 50%, such as, for example, up to about 25%. According to still another aspect, the non-sand fraction may be added to the dry molding sand additive formulation added as a solid.

According to still another aspect, the method may include at least partially dewatering the non-sand fraction. The at least partially dewatering the non-sand fraction may include dewatering the non-sand fraction. According to some aspects, the non-sand fraction may be at least partially dewatered prior to adding the non-sand fraction to the dry molding sand additive formulation. According to yet a further aspect, the dewatering may include at least one of spray drying the non-sand fraction, flocculation, hydraulic separation, or combinations thereof. According to another aspect, flocculation may include adding a polymeric flocculant.

According to some aspects, the dewatering, such as, for example, spray drying, may reduce the moisture content of the non-sand fraction to less than about 30% by weight. For example, the dewatering (e.g., spray drying, flocculation, and/or hydraulic separation) may reduce the moisture content of the non-sand fraction to less than about 25% by weight, less than about 20%, less than about 15%, less than about 10%, or less than about 5% by weight.

According to still another aspect, the dewatering, such as, for example, spray drying, flocculation, and/or hydraulic separation, may reduce the moisture content of the non-sand fraction to within the range of about 0% to about 30% by weight, such as, for example, to within a range from about 0% to about 15%, from about 0% to about 10%, from about 0% to about 5%, from about 10% to about 25%, from about 10% to about 20%, from about 20% to about 30%, from about 5% to about 15%, from about 5% to about 10%, from about 10% to about 15%, from about 15% to about 20%, or from about 25% to about 30% by weight.

According to another aspect, the non-sand fraction may not be dried below a moisture content of 25% by weight prior to adding the non-sand fraction to the dry molding sand additive formulation.

According to another aspect, the method may include disrupting the hydrogen bonding of the non-sand fraction by heating the non-sand fraction to a temperature in a range from about 100° C. to about 350° C., such as, for example, in a range from about 100° C. to about 200° C., from about 150° C. to about 250° C., from about 250° C. to about 350° C., from about 100° C. to about 150° C., from about 150° C. to about 200° C., from about 200° C. to about 250° C., from about 250° C. to about 300° C., or from about 300° C. to about 350° C.

According to another aspect, the method may include preparing a molding sand including the dry molding sand additive.

According to still another aspect, a molding sand including the molding sand additive may have a compactability greater than about 40%, such as, for example, greater than or equal to about 41%, greater than or equal to about 42%, greater than or equal to about 43%, greater than or equal to about 44%, greater than or equal to about 45%, greater than or equal to about 46%, or greater than or equal to about 47%.

According to some aspects, a molding sand including the molding sand additive may have a compactability in a range from about 40% to about 50%, such as, for example, in a range from about 43% to about 47%, or from about 44% to about 46%.

According to still another aspect, a molding sand including the molding sand additive can have a green compression strength greater than about 15.5 N/cm$^2$. For example, the dry molding sand additive may have a green compression strength greater than or equal to about 16.0 N/cm$^2$, greater than or equal to about 16.5 N/cm$^2$, greater than or equal to about 17.0 N/cm$^2$, or greater than or equal to about 17.5 N/cm$^2$.

According to still another aspect, a molding sand including the molding sand additive can have a green compression strength in a range from about 15.5 N/cm$^2$ to about 18.0 N/cm$^2$, such as, for example, in a range from about 16.0 N/cm$^2$ to about 17.5 N/cm$^2$, from about 16.5 N/cm$^2$ to about 17.5 N/cm$^2$, from about 17.0 N/cm$^2$ to about 17.5 N/cm$^2$, or from about 17.5 N/cm$^2$ to about 18.0 N/cm$^2$.

According to another aspect, a molding sand including the molding sand additive can have a green shear strength greater than about 3.5 N/cm$^2$, such as, for example, greater than or equal to about 3.6 N/cm$^2$, greater than or equal to about 3.7 N/cm$^2$, greater than or equal to about 3.8 N/cm$^2$, greater than or equal to about 3.9 N/cm$^2$, greater than or equal to about 4.0 N/cm$^2$, greater than or equal to about 4.1 N/cm$^2$, greater than or equal to about 4.2 N/cm$^2$, greater than or equal to about 4.3 N/cm$^2$, greater than or equal to about 4.4 N/cm$^2$, or greater than or equal to about 4.5 N/cm$^2$.

According to another aspect, a molding sand including the molding sand additive can have a green shear strength in a range from about 3.3 N/cm$^2$ to about 4.7 N/cm$^2$, such as, for example, in a range from about 3.5 N/cm$^2$ to about 4.5 N/cm$^2$, or from about 3.7 N/cm$^2$ to about 4.2 N/cm$^2$.

According to still another aspect, a molding sand including the molding sand additive can have a permeability greater than about 65, such as, for example, greater than about 70, greater than or equal to about 72, greater than or equal to about 73, greater than or equal to about 74, greater than or equal to about 75, greater than or equal to about 76, greater than or equal to about 77, or greater than or equal to about 78.

According to a further aspect, a molding sand including the molding sand additive can have a permeability in a range from about 65 to about 80, such as, for example, in a range from about 70 to about 80, from about 70 to about 75, from about 73 to about 78, or from about 75 to about 80.

According to still another aspect, a molding sand including the molding sand additive can have a dry compression strength greater than about 36 N/cm$^2$. For example, the dry molding sand additive may have a dry compression strength greater than or equal to about 40 N/cm$^2$, greater than or equal to about 45 N/cm$^2$, greater than or equal to about 50 N/cm$^2$, greater than or equal to about 55 N/cm$^2$, greater than or equal to about 60 N/cm$^2$, greater than or equal to about 65 N/cm$^2$, greater than or equal to about 70 N/cm$^2$, greater than or equal to about 75 N/cm$^2$, or greater than or equal to about 80 N/cm$^2$.

According to some embodiments, a molding sand including the molding sand additive can have a dry compression strength in a range from about 35 N/cm$^2$ to about 90 N/cm$^2$, such as, for example, in a range from about 40 N/cm$^2$ to about 85 N/cm$^2$, from about 40 N/cm$^2$ to about 60 N/cm$^2$, from about 50 N/cm$^2$ to about 70 N/cm$^2$, from about 60 N/cm$^2$ to about 80 N/cm$^2$, from about 40 N/cm$^2$ to about 50 N/cm$^2$, from about 45 N/cm$^2$ to about 55 N/cm$^2$, from about 50 N/cm$^2$ to about 60 N/cm$^2$, from about 55 N/cm$^2$ to about 65 N/cm$^2$, from about 60 N/cm$^2$ to about 65 N/cm$^2$, from about 65 N/cm$^2$ to about 75 N/cm$^2$, or from about 70 N/cm$^2$ to about 80 N/cm$^2$.

According to some embodiments, a molding sand including the molding sand additive can have a wet tensile strength in a range from about 0.10 N/cm$^2$ to about 0.50 N/cm$^2$, such as, for example, in a range from about 0.15 N/cm$^2$ to about 0.30 N/cm$^2$, from about 0.20 N/cm$^2$ to about 0.40 N/cm$^2$, from about 0.25 N/cm$^2$ to about 0.45 N/cm$^2$, from about 0.35 N/cm$^2$ to about 0.45N/cm$^2$, from about 0.30 N/cm$^2$ to about 0.40 N/cm$^2$, or from about 0.20 N/cm$^2$ to about 0.30 N/cm$^2$.

According to another aspect, a molding sand including the molding sand additive can have a cone jolt toughness greater than about 23 jolts, such as, for example, greater than or equal to about 25 jolts, greater than or equal to about 30 jolts, greater than or equal to about 33 jolts, greater than or equal to about 35 jolts, greater than or equal to about 38 jolts, greater than or equal to about 40 jolts, greater than or equal to about 42 jolts, or greater than or equal to about 45 jolts.

According to another aspect, a molding sand including the molding sand additive can have a cone jolt toughness in a range from about 23 jolts to about 50 jolts, such as, for example, in a range from about 28 jolts to about 48 jolts, from about 30 jolts to about 45 jolts, from about 30 jolts to about 40 jolts, from about 35 jolts to about 45 jolts, from about 40 jolts to about 50 jolts, from about 30 jolts to about 35 jolts, from about 35 jolts to about 40 jolts, from about 40 jolts to about 45 jolts, or from about 45 jolts to about 50 jolts.

According to another aspect, a molding sand including the molding sand additive can have a friability less than about 7.4%. For example, the dry molding sand additive may have a friability less than or equal to about 7.0%, less than or equal to about 6.5%, less than or equal to about 6.0%, less than or equal to about 5.5%, less than or equal to about 5.0%, less than or equal to about 4.5%, less than or equal to about 4.0%, less than or equal to about 3.5%, or less than or equal to about 3.0%.

According to another aspect, a molding sand including the molding sand additive can have a friability in a range from about 2.0% to about 7.0%, such as, for example, in a range from about 2.5% to about 6.0%, from about 3.0% to about 5.5%, from about 3.0% to about 5.0%, from about 3.0% to about 4.0%, from about 3.5% to about 4.5%, from about 4.0% to about 5.0%, or from about 4.5% to about 5.5%.

According to still another aspect, a method of forming a molding sand additive may include recovering a non-sand fraction from an overflow green sand foundry waste, recovering a sand fraction from the green sand bag house dust recovery installation, and adjusting the relative levels of clay and carbon in said non-sand fraction. The non-sand fraction may include a recovered clay component and a recovered carbon component.

According to still a further aspect, the method may include dewatering the non-sand fraction.

According to still another aspect, the method may include forming a molding sand additive from the adjusted non-sand fraction and the recovered sand fraction.

According to still another aspect, the method may include hydraulically separating the non-sand fraction after adjusting the composition of the non-sand fraction.

According to still another aspect, a method of forming a molding sand additive having a desired clay and carbon content may include recovering a waste molding sand additive composition having a clay or carbon content differing from a desired clay and carbon content, recycling the waste molding sand additive as a raw material in production of a fresh molding sand additive, and adjusting the amount of at least one of fresh clay or carbon added during production of the fresh molding sand additive to achieve the desired clay and carbon content based on the clay or carbon content of the recycled molding waste sand additive.

According to another aspect, the molding sand additive may be a dry molding sand additive. According to a further aspect, the method may include dewatering the recovered waste molding sand additive composition. According to a further aspect, the waste molding sand additive composition may include at least one of bag house dust, green overflow sand, or molding waste.

According to some aspects, the waste molding sand additive may be recovered from a molding sand additive production facility. According to some aspects, the waste molding sand additive may be recovered from a sand molding process.

According to some aspects, the recovered waste molding sand additive may include previously recycled material.

According to still another aspect, a method of molding a metal part may include providing a molding medium that may include a dry recovered non-sand fraction and a sand fraction. The non-sand fraction may include a recovered clay component and a recovered carbon component. The method may further include forming a green sand mold and adding a molten metal to the green sand mold.

According to still another aspect, the method may include adding water to the dry recovered non-sand fraction prior to providing the dry molding sand. The added water may include recovered water from a sand molding process.

DETAILED DESCRIPTION

Figure 1:
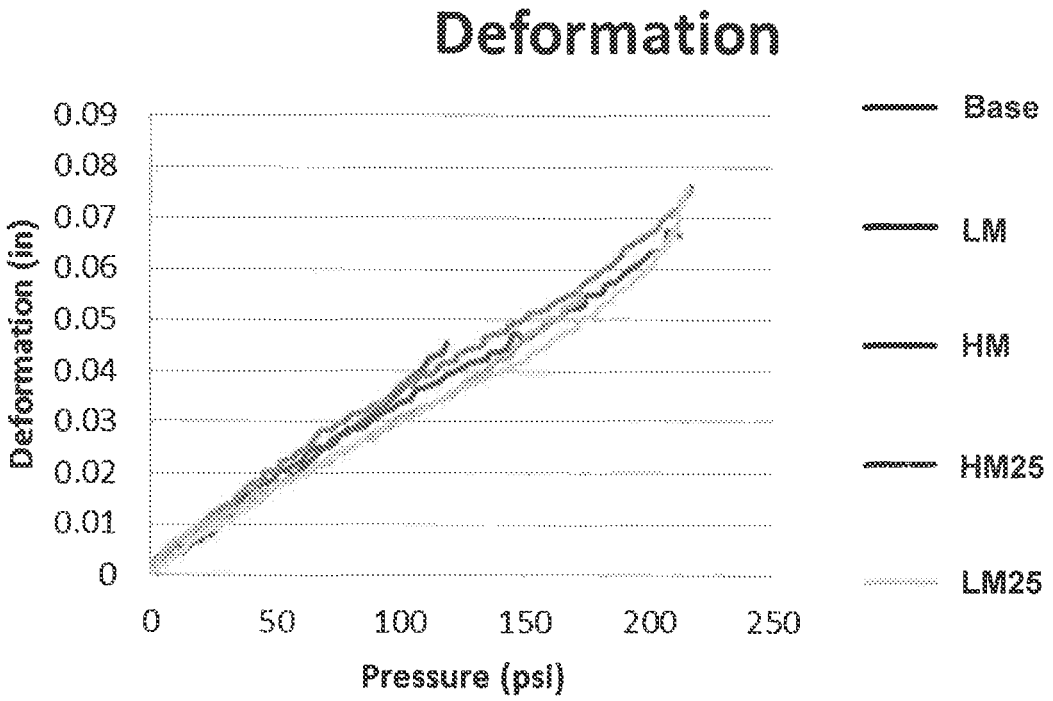
FIG. 1 shows a graph of deformation of exemplary dry molding sand additives.

It is to be understood that the figures and descriptions of the present disclosure have been simplified to illustrate elements that are relevant for a clear understanding of the disclosure, while eliminating for purposes of clarity, other elements that may be well known or understood by those of skill in the art.

The present disclosure describes systems and methods that reduce overall waste at casting facilities while at the same time providing valuable pre-mix, such as molding sand additives, used in cast molding. The process of breaking used sand molds after casting results in a significant volume of waste products. Some of that waste (molding waste) is unable to be reused in generating new sand molds and is handled manually for discarding.

A large volume of foundry waste, however, can be captured by the foundry's air evacuation system, for example, when air from the foundry facility is captured and passed through a large filtration system called a bag house. The solid particles collected there are generally referred to as "bag house dust" and are made up of substantial amounts of clay and organic material, in addition to sand. In some instances, bag house dust may typically include from about 15 wt % to about 70 wt % by weight sand, from about 20 wt % to about 85 wt % by weight bentonite clay, and from about 10 wt % to about 40 wt % by weight organic additives. The high levels of bentonite clay and organic additives present in bag house dust make it a potentially valuable source of raw materials for additives used in green cast molding.

Foundry waste can also be captured in the form of green overflow sand or molding waste. "Molding waste" may be captured when green sand molds and cores are broken down after casting. In some green sand foundries, the molding waste may contain from about 80% by weight to about 90% by weight sand, from about 6% to about 10% by weight bentonite clay, and from about 1% to about 4% by weight organic additives. Molding waste includes sand that is coated with bond as well as individual particles of sand, bentonite, and organic additives. "Green overflow sand" refers to excess foundry green molding sand (wet) that is generated in the metal casting process.

The methods and systems of this disclosure may utilize one or more of captured bag house dust, molding waste, or green overflow sand to generate a dry molding sand additive. "Dry" refers to the feel (touch) of the molding sand additive, not that it is necessarily moisture free. Commercial molding sand additive typically has a maximum of 15% moisture content by weight. In this disclosure, the "dry" molding sand additive would be similar, however with a maximum of 30% moisture content by weight, for example, a maximum of 20% moisture content by weight.

In some embodiments, the methods and systems of this disclosure may utilize one or more of captured bag house dust, molding waste, or green overflow sand to generate a molding sand additive for cast molding. For example, the sand and non-sand fractions of the bag house dust, molding waste, or green overflow sand are separated from one another using methods known in the art. This separation may allow for adjusting of component levels in the non-sand fraction in the molding sand additive. The high levels of clay and organic additives found in the raw or separated non-sand fraction allow recovered molding waste products to provide important components for casting compositions that can be reused or recycled with non-recycled or "fresh" materials, such as non-recycled non-sand fractions or non-recycled sand fractions. In some embodiments, the resulting molding sand additive or molding sand composition may include components of previously recycled non-sand or sand fractions.

In some embodiments, the non-sand fraction of the molding waste may have low levels of other impurities (e.g., sulfur) when compared to commercially available pre-mix and thus represents an improvement over the prior art. In some embodiments, the sulfur may be less than 0.03% by weight of the mixture.

In some embodiments, the collected molding waste may be separated using a hydraulic separation process, either alone or in combination with other separation processes.

In some embodiments, the water content of the recovered molding waste may be reduced through dewatering processes, such as, for example, spray drying, flocculation, hydraulic separation, and/or cross-flow filtration. Water reduction may reduce the moisture content of the dry molding sand additive to between 0% and 20% by weight. According to some embodiments, the moisture content of the non-sand fraction may be kept at above 20% by weight, or above about 25% by weight, to maintain beneficial properties of hydrated bentonite in the non-sand fraction.

A slurry of recovered material for use in a molding sand additive or molding sand composition may contain a sand component, a non-sand component, or a combination of both components. If desired, the slurry may be dewatered partially or completely according to a specific requirement for a casting process.

The relative levels of various components found in the non-sand fraction of the recovered portion of the molding waste may be adjusted by addition of clay or organic compounds to achieve the appropriate concentrations to form a molding sand additive having desired properties. The addition of clay or organic components may include non-recycled or "fresh" clay or organic compounds that are not recovered from a sand molding process. According to some embodiments, the addition of clay or organic components may include previously recycled clay or organic components from a sand molding process. The specific amount of additives will depend on the specific composition of the recovered portion of the molding waste, and will depend on the requirements of the new molding sand composition dictated by customers or the needs of the next casting. The pH of the molding sand additive is generally basic and may be in the range of a pH of about 7 to about 11. Once established, the molding sand additive may be combined with molding sand that has been previously used in a casting process to generate new molding sand able to be used effectively in casting processes.

According to some embodiments, the use of recycled non-sand fractions from molding waste may improve the properties of the dry molding sand additive, such as, for example, by increasing one or more of the green compression strength, the green shear strength, the permeability, the dry compression strength, and/or the cone jolt toughness. The use of recycled non-sand fractions from molding waste may improve the properties of the dry molding sand additive, such as, for example, by decreasing the friability of the dry molding sand additive.

Several specific examples are provided. Each example includes a batch of sand molding medium for forming moldings to be used in the casting of iron articles, although other metals could be cast. The batches of sand molding media in the several examples have commonalities, which facilitate an appreciation of the improvements of the present disclosure.

Examples

A base composition of molding sand additive was obtained containing 65% by weight bentonite (sodium bentonite) clay and 35% by weight of a carbon component (sea coal). Non-sand fractions of clay components and carbon components of bag house dust were recovered using hydraulic separation. The recovered non-sand fractions were separated into two batches and spray dried to dewater the recovered fraction. The first spray-dried batch was dewatered to a 4.4% moisture content ("low moisture" or "LM"). and the second spray-dried batch was dewatered to about 18.4% ("high moisture" or "HM"). The recovered HM and LM non-sand fractions were then mixed with the base material as shown in Table 1 below.

TABLE 1

| Sample | Base (wt %) | Recovered Spray Dried LM (wt %) | Recovered Spray Dried HM (%) |
|---|---|---|---|
| Base | 100 | 0 | 0 |
| LM | 0 | 100 | 0 |
| HM | 0 | 0 | 100 |
| LM25 | 75 | 25 | 0 |

TABLE 1-continued

| Sample | Base (wt %) | Recovered Spray Dried LM (wt %) | Recovered Spray Dried HM (%) |
|---|---|---|---|
| LM50 | 50 | 50 | 0 |
| LM75 | 25 | 75 | 0 |
| HM25 | 75 | 0 | 25 |
| HM50 | 50 | 0 | 50 |
| HM75 | 25 | 0 | 75 |

Each sample was then mixed with 7 wt % clay (sodium bentonite) and mulled for seven minutes using a Simpson Laboratory Muller. Water was then added to each sample until a compactability of about 46% was achieved.

Each example was formed into a standard molding sand according to the specified test methods and tested to determine its physical characteristics, including green strength, dry strength, and permeability, using foundry testing methods as outlined by the American Foundry Society in their published Mold and Core Test Handbook, which is hereby incorporated by reference. The procedures used can be found in the edition published by the American Foundry Society (www.afsinc.org), 3rd Edition, 2001. The testing references include AFS 2110-00-s (Clay, AFS Method), AFS 2201-00-s, (Sand Mixture Preparation, Clay Method), AFS 2206-00-s (Tensile, Wet, Mold Sand), AFS 2204-00-s (Shear Strength, Green or Dried), AFS 2211-00-s (Methylene Blue Clay test), AFS 2218-00-s (Moisture Determination, Forced Hot Air Method), AFS 2220-00-s (Compactability of Molding Sand Mixtures, Rammer Method), AFS 2248-00-s (Friability), AFS 2249-00-s (Cone Jolt Toughness), AFS 5234-00-s (Compression Strength, Hot), all of which are incorporated by reference.

The results of the testing are shown in Table 2 below.

TABLE 2

| Test | Base | LM | HM | HM25 | LM25 | HM50 | LM50 | HM75 | LM75 |
|---|---|---|---|---|---|---|---|---|---|
| Moisture (%) | 2.1 | 2.7 | 3.0 | 2.8 | 2.5 | 2.4 | 2.7 | 2.7 | 2.8 |
| Compactability (%) | 45 | 47 | 47 | 45 | 46 | 45 | 46 | 46 | 44 |
| Green Compression Strength ($N/cm^2$) | 16.6 | 15.6 | 16.1 | 17.2 | 17.5 | 17.1 | 16.7 | 15.9 | 17.1 |
| Green Shear Strength ($N/cm^2$) | 3.9 | 3.3 | 3.8 | 4.5 | 4.0 | 3.9 | 3.8 | 3.6 | 4.3 |
| Permeability | 74 | 64 | 63 | 75 | 78 | 73 | 77 | 75 | 76 |
| Wet Tensile Strength ($N/cm^2$) | 0.38 | 0.14 | 0.14 | 0.42 | 0.41 | 0.34 | 0.34 | 0.20 | 0.23 |
| Dry Compression Strength ($N/cm^2$) | 36 | 80 | 94 | 40 | 42 | 58 | 62 | 77 | 56 |
| Cone Jolt Toughness | 23 | 36 | 42 | 34 | 35 | 33 | 40 | 46 | 36 |
| Friability (%) | 7.4 | 1.7 | 2.3 | 4.7 | 5.2 | 3.9 | 3.8 | 2.0 | 4.0 |

As shown in Table 2 above, the green compression strength, green shear strength, and permeability for each sample LM25, LM50, LM75, HM25, HM50, and HM75 either increased or remained comparable to the base material. The wet tensile strength increased for both HM25 and LM25, but decreased slightly for HM50 and LM50. Dry compression strength and cone jolt toughness both increased significantly for each of LM25, HM25, LM50, HM50, LM75, and HM75. Friability decreased significantly for each of LM25, HM25, LM50, HM50, LM75, and HM75. These results show that recovered spray dried fractions of molding waste can be recycled into a sand mold additive without adversely affecting the properties of the additive. For several properties, as shown in Table 2, the properties of the additive, such as cone jolt toughness, friability, permeability, and various strength measurements may be increased by adding the recovered material.

Deformation of the base sample and samples LM, HM, LM25, and HM25 was measured at various pressures from 0 psi to 200 psi using a Dietert Dialotometer with a deformation gauge and graphed in a computer program. FIG. 1 shows the results of the deformation test. As shown in FIG. 1, each of samples LM, HM, LM25, and HM25 exhibited slightly less deformation than the base material, with LM25 and HM25 exhibiting the lowest amount of deformation.

Figure 2:
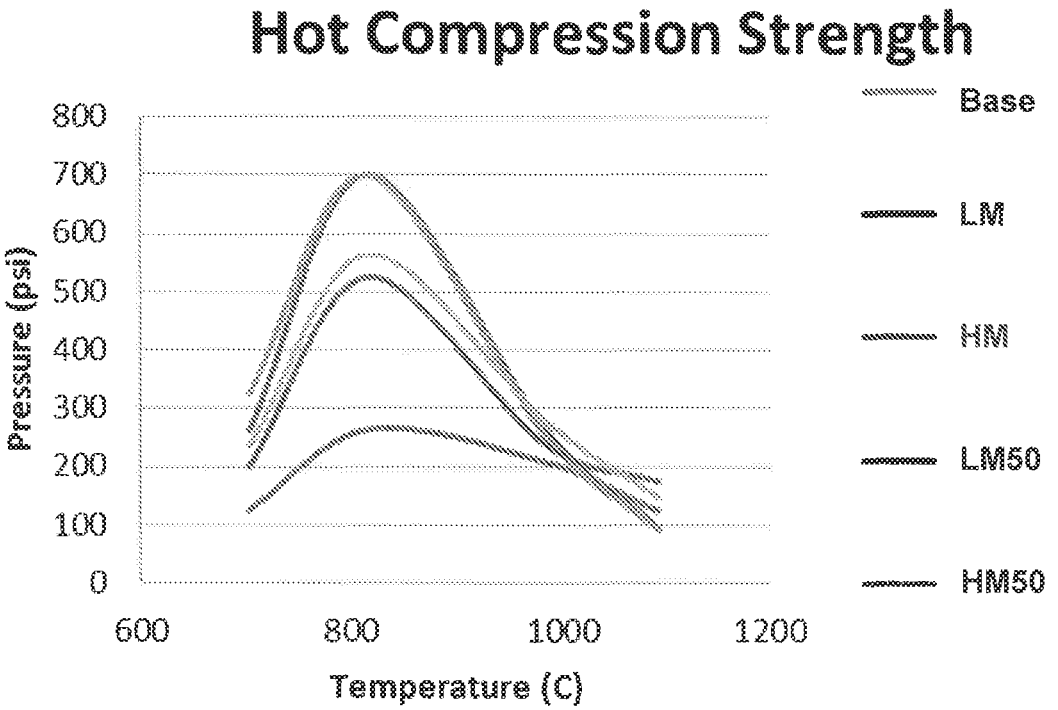
FIG. 2 shows a graph of hot strength compression of exemplary dry molding sand additives.

Hot compression strength of the base sample and samples LM, HM, LM50, and HM50 was measured using a Dietert Dialotometer with a deformation gauge and graphed in a computer program at four temperatures: 538° C. (1000° F.), 816° C. (1500° F.), 982° C. (1800° F.), and 1093° C. (2000° F.). The specimens were prepared using a pneumatic squeezer method (AFS Mold and Core Test Handbook method AFS 2221-00-s) in a plurality of cylinders with 53 to 55 gram specimens based upon the density of the prepared molding sand, the results of which are shown in FIG. 2. As shown in FIG. 2, the hot compression strength for LM, HM, LM50, and HM50 increased significantly as compared to the base material from 700° C. to about 1000° C., and samples HM50 and LM50 showed slightly higher hot compression strength relative to the base material between about 1000° C. and about 1100° C.

Figure 3A:
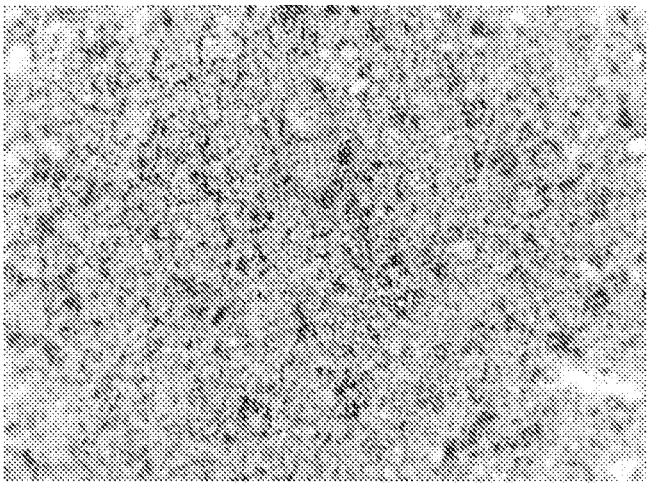
FIGS. 3A-3C show images of exemplary dry molding sand additives.
Figure 3B:
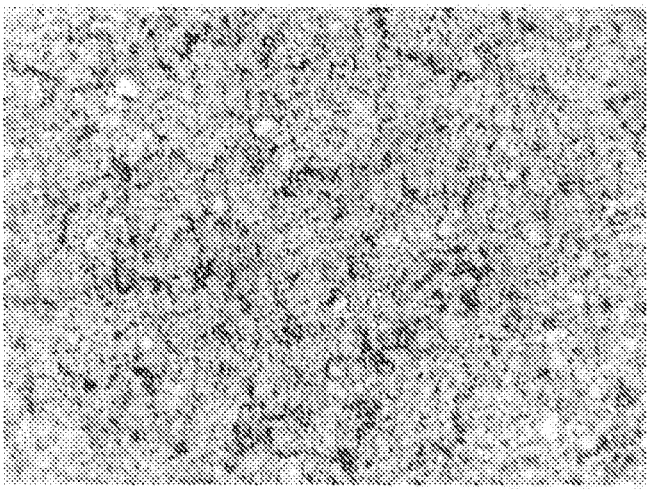
Figure 3C:
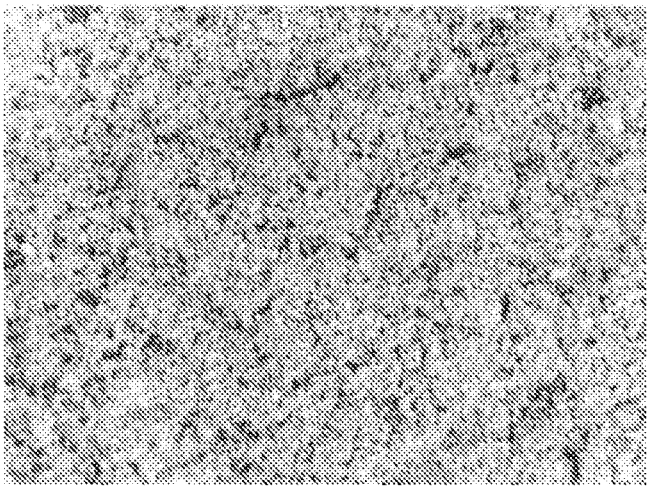

FIGS. 3A-3C shows magnified images of the base sample (FIG. 3A) with additives having 5% (FIG. 3B) and 10% (FIG. 3C) recovered non-sand fractions, which were spray dried to form dry molding sand additives. As shown in FIGS. 3A-3C, the visual composition of the dry molding sand additives is unchanged with the addition of the recovered non-sand components.

As shown in these examples, recovered non-sand fractions can be recovered from molding waste, spray dried, and recycled or reintroduced into molding sand additives to beneficially affect the properties of the molding sand additives. The components and physical properties of the raw materials generated from molding waste may be adjusted through addition of components or purification (e.g., through water reduction) to obtain appropriate final levels for a foundry-ready molding sand additive. The present disclosure represents an improvement over prior art both in reduction of foundry waste and production of high quality molding sand additives for casting processes.

Nothing in the above description is meant to limit the scope of the claims to any specific composition or structure of components. Many substitutions, additions, or modifications are contemplated within the scope of the present invention and will be apparent to those skilled in the art. The embodiments described herein were presented by way of example only and should not be used to limit the scope of the claims.

What is claimed is:

1. A method of forming a dry molding sand additive having a maximum moisture content of 30% by weight, comprising the steps of:

recovering a non-sand fraction from a foundry waste material, wherein said non-sand fraction comprises a recovered clay component and a recovered carbon component further comprising at least partially dewatering the non-sand fraction and wherein said dewatering includes spray drying; and adding the non-sand fraction to a dry molding sand additive formulation to form a dry molding sand additive to reduce an amount of fresh clay and carbon to produce the dry molding sand additive.

2. The method of forming a dry molding sand additive of claim 1, wherein said foundry waste material comprises bag house dust.

3. The method of forming a dry molding sand additive of claim 1, wherein said foundry waste material comprises overflow green sand.

4. The method of forming a dry molding sand additive of claim 1, wherein said foundry waste material comprises a mixture of bag house dust and overflow green sand.

5. The method of forming a dry molding sand additive of claim 1, wherein said foundry waste material comprises molding waste.

6. The method of forming a dry molding sand additive of claim 1, wherein a moisture content of the dry molding sand additive is in a range from about 0% to about 15% by weight.

7. The method of forming a dry molding sand additive of claim 1, further comprising adjusting a composition of the dry molding sand additive such that a methylene blue adsorption value of the dry molding sand additive is in a range from about 70% to about 95%.

8. The method of forming a dry molding sand additive of claim 1, wherein a clay content of the dry molding sand additive is in a range of from about 60 wt % to about 90 wt %.

9. The method of forming a dry molding sand additive of claim 1, wherein a carbon content of the dry molding sand additive is in a range of from about 10 wt % to about 25 wt %.

10. The method of forming a dry molding sand additive of claim 1, further comprising disrupting hydrogen bonding of the non-sand fraction by heating the non-sand fraction to a temperature in a range from about 100° C. and about 350° C.

11. The method of forming a dry molding sand additive of claim 1, wherein a green sand prepared using the dry molding sand additive has a compactability greater than about 45%.

12. The method of forming a dry molding sand additive of claim 1, wherein a green sand prepared using the dry molding sand additive has a green compression strength greater than about 15.5 $N/cm^2$.

13. The method of forming a dry molding sand additive of claim 1, wherein a green sand prepared using the dry molding sand additive has a green shear strength greater than about 3.5 $N/cm^2$.

14. The method of forming a dry molding sand additive of claim 1, wherein a green sand prepared using the dry molding sand additive has permeability greater than about 65.

15. The method of forming a dry molding sand additive of claim 1, wherein a green sand prepared using the dry molding sand additive has a dry compression strength greater than about 36 $N/cm^2$.

16. A method of forming a molding sand additive having a maximum moisture content of 30% by weight, comprising the steps of:

recovering a non-sand fraction from an overflow green sand foundry waste, wherein said non-sand fraction comprises a recovered clay component and a recovered carbon component further comprising at least partially dewatering the non-sand fraction and wherein said dewatering includes spray drying;

recovering a sand fraction from a green sand bag house dust recovery installation; and adjusting relative levels of clay and carbon in said non-sand fraction.

17. A method of forming a molding sand additive having a maximum moisture content of 30% by weight, comprising the steps of:

recovering a waste molding sand additive composition having a clay or carbon content differing from a desired clay and carbon content; wherein recovering a recovered clay component or a recovered carbon component further comprises at least partially dewatering, wherein said dewatering includes spray drying recycling the waste molding sand additive as a raw material in production of a fresh molding sand additive; and adjusting an amount of at least one of fresh clay or carbon added during production of the fresh molding sand additive to achieve the desired clay and carbon content based on the clay or carbon content of the recycled molding waste sand additive.

* * * * *